US005873376A

United States Patent [19]

Howley

[11] Patent Number: 5,873,376

[45] Date of Patent: Feb. 23, 1999

[54] METHOD AND APPARATUS FOR HAIR HOLDING AND ADORNMENT

[76] Inventor: Joanne Howley, 25 West Constitution Dr., Bordentown, N.J. 08505

[21] Appl. No.: 157,968

[22] Filed: Sep. 21, 1998

[51] Int. Cl.[6] ..... A45D 24/00

[52] U.S. Cl. ..... 132/200; 132/273

[58] Field of Search ..... 132/273, 275, 132/200, 245, 246, 248, 212; 2/171, 174, 182.6, 182.1

[56] References Cited

U.S. PATENT DOCUMENTS

| | | | |
|---|---|---|---|
| 1,146,934 | 7/1915 | Gleeson | 132/273 |
| 4,465,085 | 8/1984 | Schopieray | 132/248 |
| 5,036,870 | 8/1991 | Edmark | 132/273 |
| 5,193,558 | 3/1993 | Squatrito | 132/248 |
| 5,289,834 | 3/1994 | Lawrence | 132/212 |
| 5,487,396 | 1/1996 | Wilson | 132/248 |
| 5,499,638 | 3/1996 | Ripley | 132/273 |
| 5,623,953 | 4/1997 | McDowell | 132/200 |

*Primary Examiner*—Gene Mancene
*Assistant Examiner*—Pedro Philogene
*Attorney, Agent, or Firm*—Sperry, Zoda & Kane

[57] ABSTRACT

A method and apparatus for holding and adornment of hair which makes use of a base member with first and second ends and a central base with a securement line secured to each end to define a hair holding opening therebetween. A first securement member and a second securement member are detachably securable with respect to the first base end section and the second base end section, respectively, to detachably secure the ends of the securement line thereto to facilitate ease in installing of the apparatus and responsive to removal of the securement members to facilitate removal thereof.

22 Claims, 5 Drawing Sheets

METHOD AND APPARATUS FOR HAIR HOLDING AND ADORNMENT

BACKGROUND OF THE INVENTION

1. Field of the Invention

The present invention deals generally with the field of devices for holding of hair as well as adornment thereof. Numerous devices have been patented which are designed for the purpose of holding hair in a desired position. Most usually women's hair or men with longer hair use such hair holding devices adjacent ponytails or long bundles of hair extending usually from the rear of the head of the user. The present device also includes various aspects for possible adornment making use of the hair holding member for holding hair up in a lifted position off of the shoulders and neck of the user.

2. Description of the Prior Art

Numerous prior art devices have been patented such as U.S. Pat. No. 3,301,266 patented Jan. 31, 1967 to E. Hoffmann and assigned to Tip-Top Products Company on a "Hair Holder"; and U.S. Pat. No. 3,635,228 patented Jan. 18, 1972 to N. Helkes and assigned to Pantec Development Company on an "Adornment Device"; and U.S. Pat. No. 4,307,908 patented Dec. 29, 1981 to H. Donaldson on a "Bead-Stringing Implement And Method Of Use"; and U.S. Pat. No. 4,972,859 patented Nov. 27, 1990 to E. Noviello et al on a "Hair Securement Device"; and U.S. Pat. No. 4,998,544 patented Mar. 12, 1991 to S. Obergfell on a "Combination Headband And Ponytail Holder"; and U.S. Pat. No. 5,036,870 patented Aug. 6, 1991 to T. Edmark on a "Hair Styling Tool"; and U.S. Pat. No. 5,167,245 patented Dec. 1, 1992 to D. Harriett on a "Hair Tying Apparatus And Method Of Use"; and U.S. Pat. No. 5,289,834 patented Mar. 1, 1994 to L. Lawrence on a "Ponytail Tool"; and U.S. Pat. No. 5,293,884 patented Mar. 15, 1994 to R. Chapman et al and assigned to Full Moon Fashion Accessories, Inc. on a "Loop Strap Hair Tie"; and U.S. Pat. No. 5,318,054 patented Jun. 7, 1994 to K. Neilson et al on a "Spiral Spring Hair Barrette Assembly"; and U.S. Pat. No. 5,417,230 patented May 23, 1995 to D. Wood and assigned to Lee Innovations, Inc. on "Hair Styling Tools And Methods For Their Use"; and U.S. Pat. No. 5,464,030 patented Nov. 7, 1995 to M. Avellanet on a "Twist Hairdo Roller"; and U.S. Pat. No. 5,497,795 patented Mar. 12, 1996 to L. Hibbard on a "Method And Apparatus Of Braiding Hair"; and U.S. Pat. No. 5,499,638 patented Mar. 19, 1996 to J. Ripley on a "Hair Holding Device"; and U.S. Pat. No. 5,566,690 patented Oct. 22, 1996 to H. Shih-Ming on a "Hair Clip"; and U.S. Pat. No. 5,590,668 patented Jan. 7, 1997 to J. Macy on a "Hair Braiding Method And Device"; and U.S. Pat. No. 5,623,953 patented Apr. 29, 1997 to E. McDowell on a "Hair Styling Tool And Method"; and U.S. Pat. No. 5,657,776 patented Aug. 19, 1997 to B. Espenschied on a "Hair Stitching Shaft For Decorating Hair"; and U.S. Pat. No. 5,694,955 patented Dec. 9, 1997 to C. Grooms on a "Hair Holding Device"; and U.S. Pat. No. 5,669,399 patented Sep. 23, 1997 to C. Camp, Jr. et al and assigned to Hair Hoops, Inc. on a "Hair Forming Device"; and U.S. Pat. No. 5,706,837 patented Jan. 13, 1998 to H. Iwata on a "Hair Bundling Core And Method Of Using The Core"; and U.S. Pat. No. 5,727,575 patented Mar. 17, 1998 to R. Rontal on a "Hair Securing Device".

SUMMARY OF THE INVENTION

The present invention provides an apparatus for holding and adornment of hair which includes a base member extending longitudinally which includes a first base end section and a second base end section at opposite positions on the base member from one another. A central base section is positioned therebetween as defined along the longitudinally extending base member.

A securement line is preferably attachably securable with respect to the first base end section as well as to the second base end section such as to extend therebetween along the central base section of the base member. This securement line is preferably formed of a flexibly resilient material such as rubber or fabric coated rubber and defines a hair holding opening between the securement line itself and the base member. This hair holding opening is defined primarily because of the flexible resilience and longitudinal extensibility of the securement line which allows a variation in choice of the particular size of the hair holding opening by the user as desired.

A first securement member is also detachably securable with respect to the first base end section of the base member. This first securement member is preferably positioned adjacent the securement line in order to facilitate the maintaining of a detachable attachment thereof with respect to the first base end section of the base member. Similarly the second base member is detachably securable with respect to the second base end section of the base member. This second securement member is preferably positionable adjacent to the securement line in order to facilitate maintaining detachable attachment thereof with respect to the second base end section of the base member.

In the preferred configuration, the first securement member and the second securement member each comprise caps which are detachably securable with respect to the base end section. This detachable securement is made possible because each of the caps defines a capping bore extending therethrough which is adapted to receive the base end sections extending therewithin and detachably securable thereto.

In operation, the caps are designed when positioned in place to hold the securement line secured to the first and second base sections. The caps are adapted when removed to allow easy release of the attachment of the securement line to the first and second base end sections to facilitate removal of the hair holding and adornment device by the user.

The apparatus of the present invention can further include various adornment means such as an adornment means secured specifically to the external surface of the securement member or cap. Also, an auxiliary external capping member can be included to further enhance adornment therewith.

When used, the apparatus of the present invention is initially positioned adjacent to the hair of a user. The user will then extend their hand through the opening defined between the elastic securement line and the longitudinal member. A bundle of hair will then be grasped by this extended hand and this hair will be pulled through the hair holding opening defined by the holding and adornment device. The longitudinal member will then be rotated through at least 180 degrees in order to encircle the bundle of hair with the elastic securement line. This same bundle of hair will then pass through the hair holding opening a second time for further securement thereof. This bundle of hair will then be wrapped laterally about the longitudinal member of the holding and adornment apparatus to facilitate gathering thereof. The longitudinal member with the bundle of hair gathered around will then be inserted into an area of the hair of a user for holding of the hair in the securely held position for retaining thereof as well as adornment.

It is an object of the present invention to provide a method and apparatus for hair holding and adornment wherein the number of moving parts is minimized.

It is an object of the present invention to provide a method and apparatus for hair holding and adornment wherein the cost of manufacture and production is minimized.

It is an object of the present invention to provide a method and apparatus for hair holding and adornment wherein minimal maintenance requirement are necessary.

It is an object of the present invention to provide a method and apparatus for hair holding and adornment wherein ease of use is a primary concern.

It is an object of the present invention to provide a method and apparatus for hair holding and adornment wherein removal is particularly convenient and quick.

It is an object of the present invention to provide a method and apparatus for hair holding and adornment wherein holding of hair in the "up" position is easily achievable for persons with long hair.

It is an object of the present invention to provide a method and apparatus for hair holding and adornment wherein use behind the head where viewing is often rather difficult is easy and efficient.

It is an object of the present invention to provide a method and apparatus for hair holding and adornment wherein multiple devices can be used simultaneously for further enhanced holding and adornment.

It is an object of the present invention to provide a method and apparatus for hair holding and adornment wherein materials can be made clear or colored to match the hair of a user for further adornment therein.

It is an object of the present invention to provide a method and apparatus for hair holding and adornment wherein numerous different possibilities for decorating and adornment are available.

It is an object of the present invention to provide a method and apparatus for hair holding and adornment wherein use is possible by persons with various types, thickness, lengths and color of hair.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
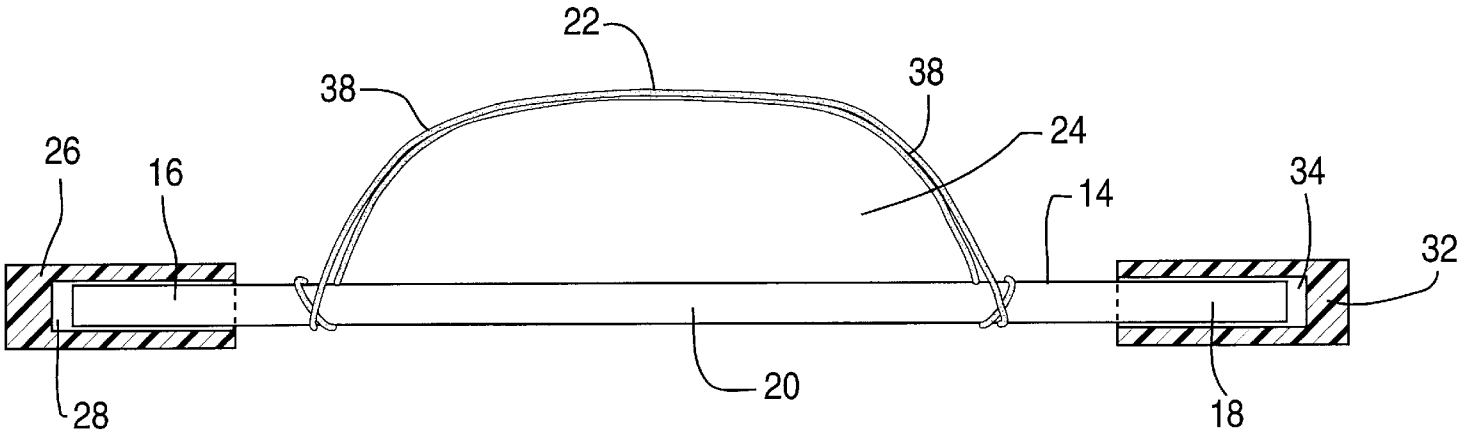
FIG. 1 is a front cross-sectional view of an embodiment of the present invention.

The present invention provides an apparatus for holding and adornment of hair 10 of a user. The user can place the hands 11 behind their head to grasp a bundle of hair 12 for securement thereof with respect to the hair holding and adornment apparatus of the present invention.

The apparatus of the present invention specifically includes a longitudinally extending base member 14 which defines thereon a first base end section 16 and a second base end section 18 spaced apart from the first base end section 16. A central base section 20 will be positioned between the first base end section 16 and the second base end section 18 for defined separation thereof.

A securement line 22 will be attached detachably with respect to the first base end section 16. Securement line 22 will also be attached with respect to the second base end section 18 such as to extend between the first and second end sections 16 and 18 along the central base section 20.

Securement line 22 in combination with the base member 14 and primarily the central base section 20 thereof will define a hair holding opening 24. Preferably the securement line 22 is formed of an elastic or rubberband type material which is coated with a fabric to prevent snagging or unwanted pulling of the hair during use of the present invention. This securement line 22 will preferably be longitudinally extensible such as to facilitate ease in defining of the hair holding opening 24 thereadjacent.

During installation of the hair holding and adornment apparatus of the present invention, it is important that the securement line 22 be attached securely with respect to the base member 14. It is also important that once the device has been installed and it is desired that the device be removed that the securement line 22 be completely detachable from the base member 14. To achieve this purpose a first securement member 26 will be included detachably securable with respect to the first base end section 16. This first securement member 26 will preferably take the form of a first cap with a first capping bore 28 defined therewithin.

In a similar manner, a second securement member 32 will be included preferably for the purpose of being detachably securable with respect to the second base end section 18 for selectively retaining the securement line 22 detachably secured therewith. It is important that the second securement member 32 when removed from engagement with the second base end section 18 will allow easy removal of the securement line 22 from second base end section 18 for removal of the device from the hair of the user. The configuration of the second securement member 32 will preferably be a second cap which defines a second capping bore means 34 defined therewithin. Second capping bore 34 will be adapted to receive extending therein the second base end section 18 for detachable securement therewith.

A first decorative attachment means 30 can be secured with respect to the first capping bore 28 as desired. In an alternative configuration an auxiliary cap member 40 may be included with a second decorative attachment means 36 secured thereto. With the auxiliary cap member 40 the decorative member will be a completely separate piece which will facilitate change in choice of the particular manner of adornment. It is within the design of the present invention that any particular type of adornment can be utilized including leather, jewelry, cloth, yarn or any other available means of hair adornment can be attached to either the auxiliary cap member 40 or directly to the first decorative attachment means 30.

The fabric coating described above is shown by reference numeral 38. This fabric coating preferably is in the form of a material extending over the longitudinally extensible elastic rubber securement line 22 to decrease the coefficient friction of the external surface thereof to prevent pulling or snagging of hair passing thereover or in abutment therewith.

There are three basic configurations for the means of attachment of the securement line with respect to the end sections of the base member shown in the present invention. These three means of attachment are shown in the three alternative embodiments of FIGS. 1, 2 and 3.

In FIG. 1 the securement line 22 is attached directly to the first base end section 16 and the second base end section 18 by looping therearound. With the first cap 26 and the second cap 32 in place the attachment of the securement line 22 will be maintained. However, once these two caps are removed the securement line can easily be slid oppositely from one another along the outer surface of the base member 14 until the securement line 22 is completely detached therefrom.

Figure 2:
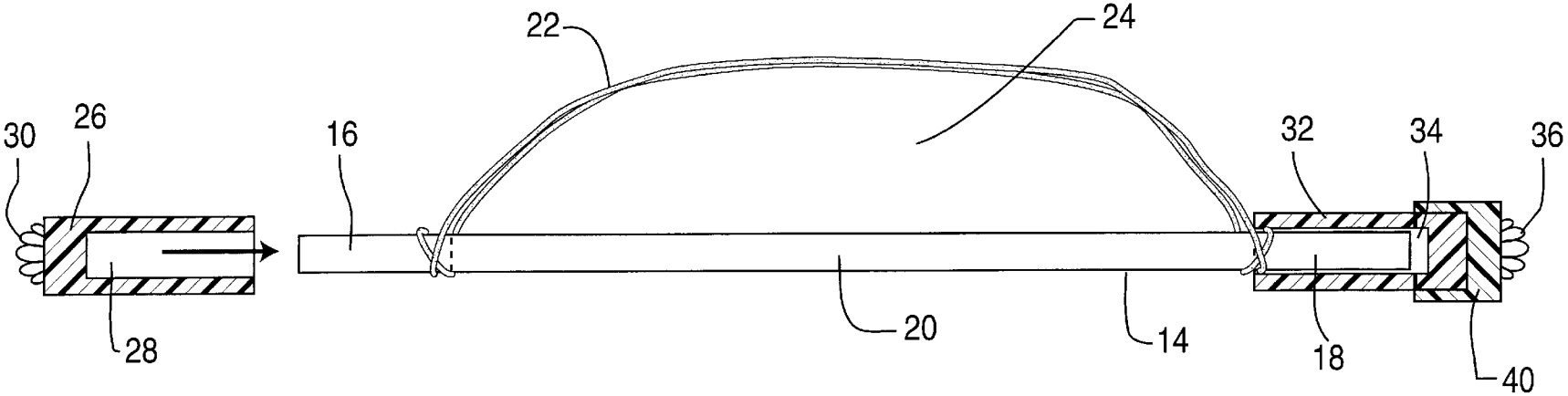
FIG. 2 is a front cross-sectional plan view of an alternative embodiment of the present invention shown with adornment.

In the alternative configuration shown in FIG. 2 a more firm securement is maintained between the securement line 22 and the base member 12 and in particular the first base end section 16 and the second base end section 18 thereof. This is achieved by forming the looped engagement between the securement line 22 and the base member 14 at a position which will be closer to the outermost ends of the first and second base end sections 16 and 18 in such a manner that the first and second caps 26 and 32 will extend over the securement line 22 at the location where it is attached looping over base member 14. Thus, with this configuration, the securement line 22 will be biased into engagement with the base member 14 by the inner walls of the first capping bore 28 and the second capping bore 34 which will be in abutment with the securement line 22 when they are secured to the first and second end sections 16 and 18. Thus removal of the first and second cap means 26 and 32 will allow the securement line 22 to be easily removed from engagement with the base member 14.

Figure 3:
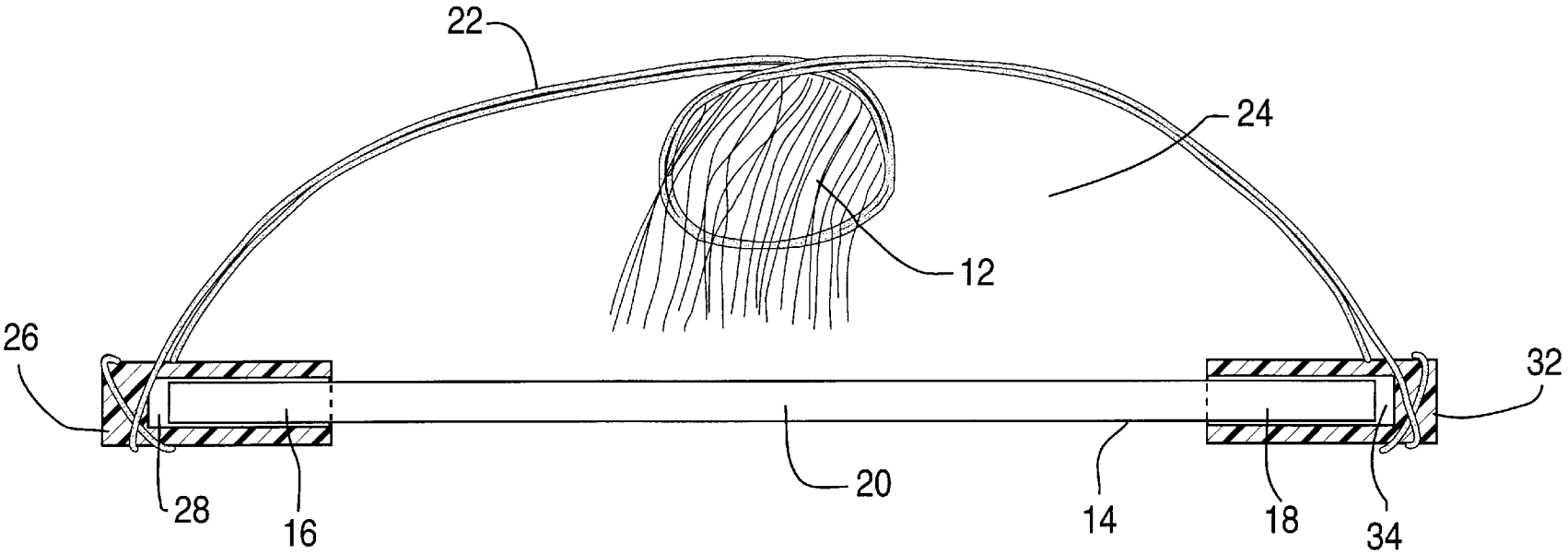
FIG. 3 is a front cross-sectional view of a further alternative embodiment.
Figure 4:
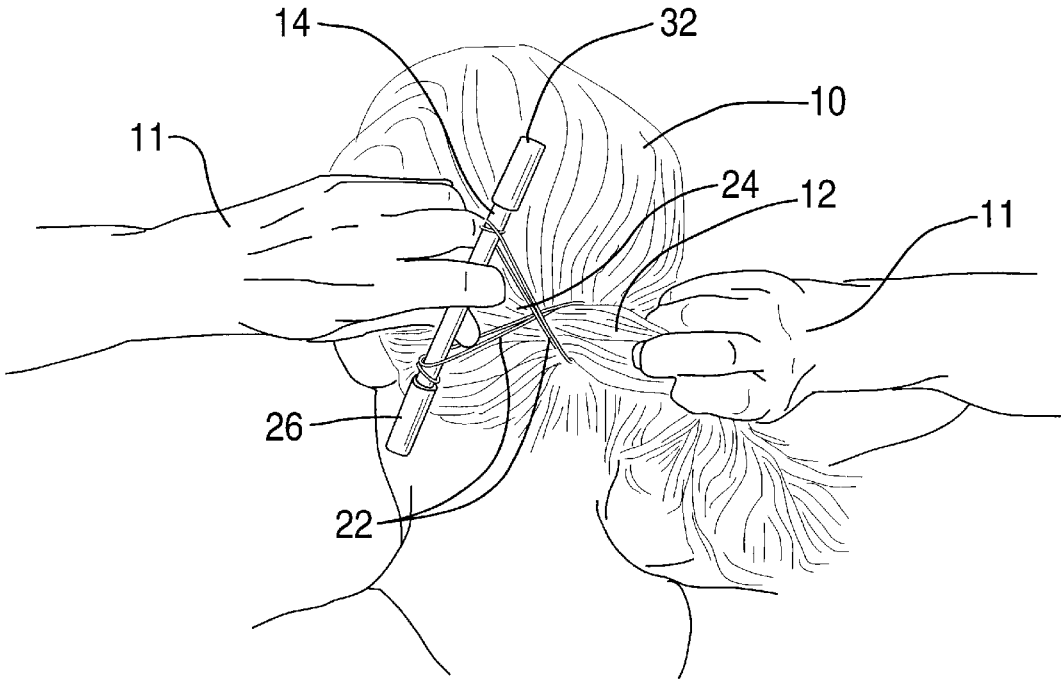
FIG. 4 is an illustration of the use of the apparatus of the present invention during the initial installation stage.
Figure 5:
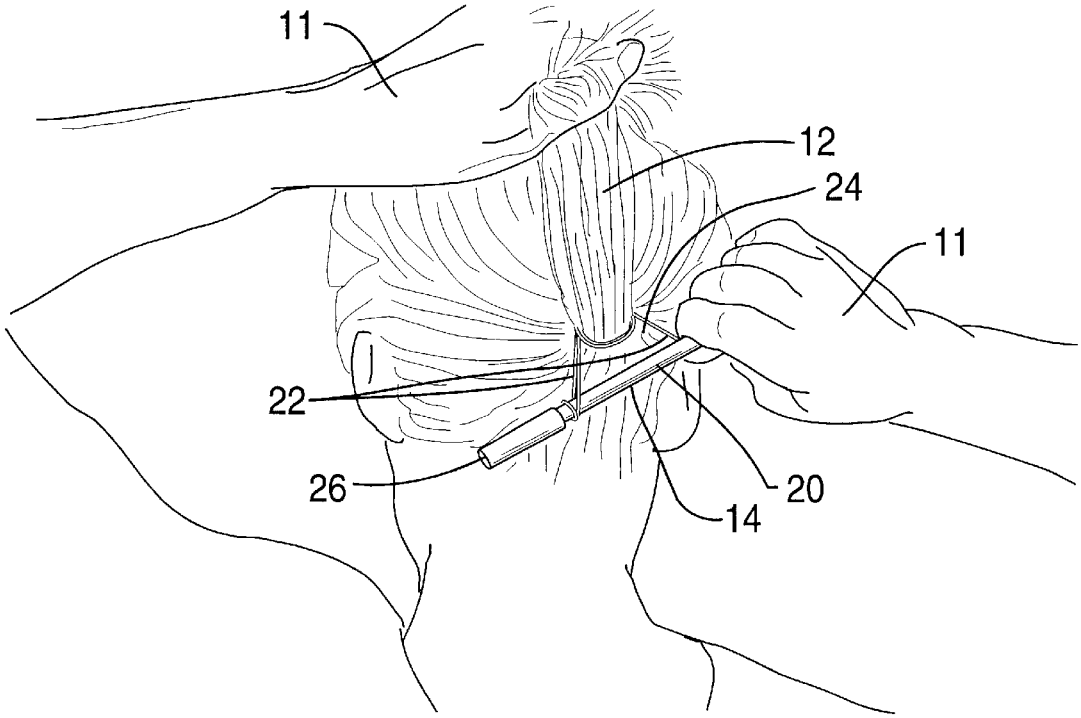
FIG. 5 shows the apparatus of the present invention after insertion of the bundle of hair through the hair retaining opening and after rotation of the longitudinal member.
Figure 6:
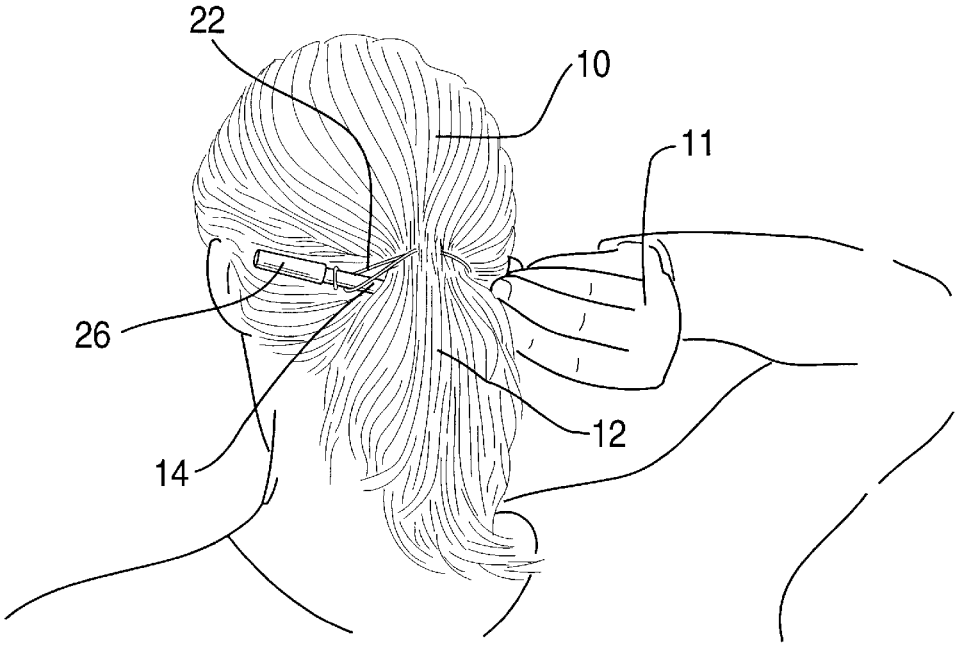
FIG. 6 illustrates the apparatus of the present invention after placing the same bundle of hair through the hair holding opening a second time.
Figure 7:
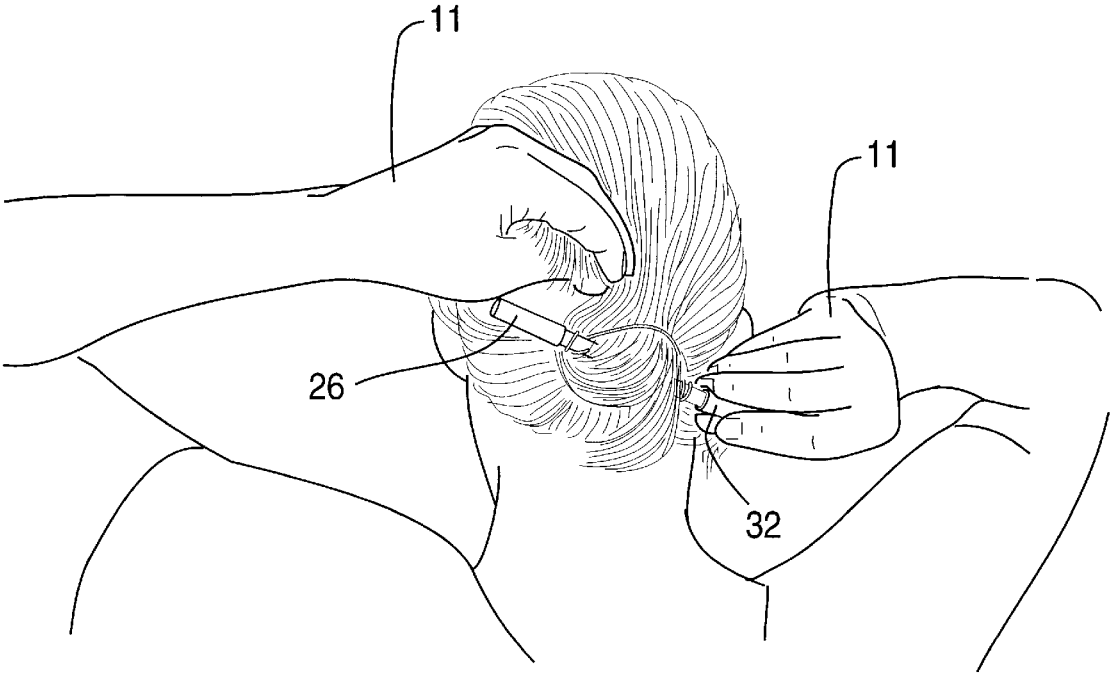
FIG. 7 shows the configuration of FIG. 6 after wrapping of the bundle of hair laterally about the longitudinal member.
Figure 9:
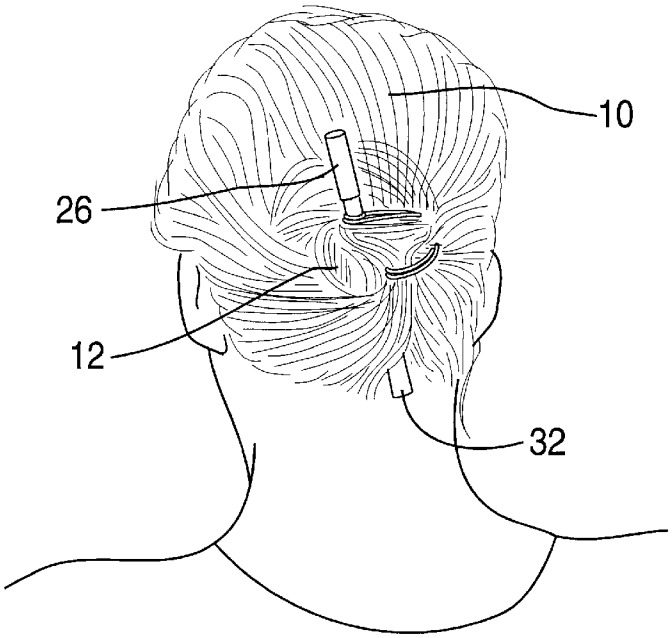
FIG. 9 is an illustration of the apparatus of the present invention in place for holding and adornment of the hair of a user.
Figure 8:
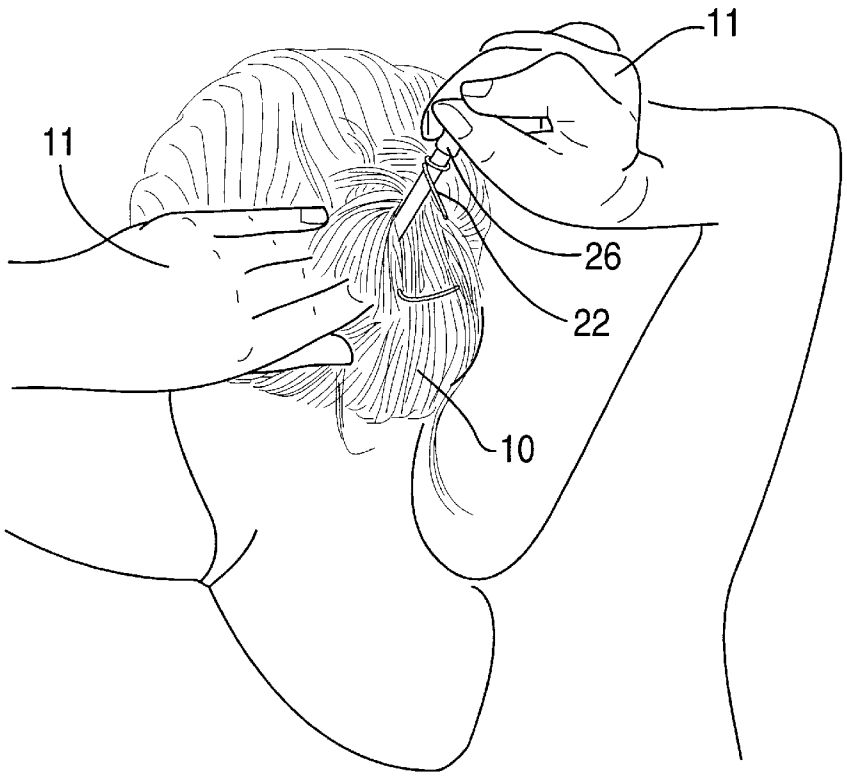
FIG. 8 shows the apparatus of the present invention during the step of inserting thereof into another area of hair of the user.

The third manner of securement is shown in FIG. 3 wherein the securement line 22 is connected directly to the first securement member 26 and the second securement member 32 and those members are in turn secured respectively with respect to the first base end section 16 and the second base end section 18. With this configuration removal of engagement of the first securement member 26 from the first base end section 16 and removal of the second securement member 32 from the second base end section 18 will obviously provide complete detachment as desired of the securement line 22 from the base member 14.

As claimed, the apparatus of the present invention is contemplated to be designed in any of these three configurations.

In use, the apparatus of the present invention is designed to be initially held with the longitudinal base member 14 and the elastic securement line 22 adjacent to the hair 10 of the user. The user will then extend her hand 11 through the hair holding opening 24 and will grip a bundle of hair 12 such as a ponytail therewith. The user will then pull this hair bundle or ponytail 12 through the hair holding opening 24 which is defined between the longitudinal base member 14 and the elastic securement line 22. Base member 14 will then be rotated through an angle of at least 180 degrees relative to the hair bundle 12 in such a manner as to encircle the bundle of hair 12 with the elastic securement line itself. This same bundle of hair 12 will then be placed through the hair holding opening 24 a second time.

Thereafter the user will wrap this hair bundle around the longitudinal base member 14 to facilitate gathering thereof. The holding and adornment device will then be inserted with the bundle of hair 12 wrapped laterally around the base member 14 into another area of the hair usually immediately below the ponytail to affix the hair bundle 12 in the elevated position for holding the hair in this position and adornment thereof.

It should be appreciated that the apparatus of the present invention can be utilized in plurality. That is, two or even more devices can be used at the same time for hair adornment and holding. Also, parts of the apparatus including the elastic securement line as well as the base member can be of any chosen color including clear to enhance hiding of the apparatus or a color chosen to match or contrast with the hair of a user.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An apparatus for hair holding and adornment comprising:

A. a base member extending longitudinally and including:
  (1) a first base end section;
  (2) a second base end section spatially disposed from said first base end section; and
  (3) a central base section defined on said base member between said first base end section and said second base end section;

B. a securement line means being detachably attachable with respect to said first base end section and to said second base end section and extending therebetween along said central base section, said securement line means being of a flexibly resilient material, said securement line means and said base member defining a hair holding opening therebetween for receiving and retaining hair therewithin;

C. a first securement member, unconnected to said securement line means, and being detachably securable with respect to said first base end section of said base member, said first securement member being positionable adjacent said securement line means to facilitate maintaining detachable attachment thereof with respect to said first base end section of said base member; and D. a second securement member, unconnected to said securement line means, and being detachably securable with respect to said second base end section of said base member, said second securement member being positionable adjacent said securement line means to facilitate maintaining detachable attachment thereof with respect to said second base end section of said base member.

2. An apparatus for hair holding and adornment as defined in claim 1 wherein said securement line means is longitudinally flexibly extensible to facilitate separation thereof from said base member to aid in defining of said hair holding opening therebetween and to facilitate gripping of hair extending therethrough.

3. An apparatus for hair holding and adornment as defined in claim 1 wherein said first securement member comprises a first cap means detachably positionable with respect to said first base end section of said base member to selectively retain said securement line means attached with respect to said first base end section of base member.

4. An apparatus for hair holding and adornment as defined in claim 3 wherein said first cap means defines a first capping bore means extending therewithin which is adapted to detachable receive said first base end section of said base member therein for facilitating detachable securement therewith.

5. An apparatus for hair holding and adornment as defined in claim 3 further comprising a first decorative attachment means being detachably securable with respect to said first cap means for selective and changeable adornment thereof.

6. An apparatus for hair holding and adornment as defined in claim 1 wherein said second securement member comprises a second cap means detachably positionable with respect to said second base end section of said base member to selectively retain said securement line means attached with respect to said second base end section of base member.

7. An apparatus for hair holding and adornment as defined in claim 6 wherein said second cap means defines a second capping bore means extending therewithin which is adapted to detachable receive said second base end section of said base member therein for facilitating detachable securement therewith.

8. An apparatus for hair holding and adornment as defined in claim 6 further comprising a second decorative attachment means being detachably securable with respect to said second cap means for selective and changeable adornment thereof.

9. An apparatus for hair holding and adornment as defined in claim 1 wherein said securement line means comprises an elastic rubber member which is longitudinally extensible and is coated with a layer of fabric material having a lower coefficient of friction than said elastic rubber member to facilitate ease of movement of hair in abutment thereagainst during placement and removal of the hair holding and adornment apparatus.

10. An apparatus for hair holding and adornment as defined in claim 1 wherein said securement line means is translucent to display hair color therethrough.

11. An apparatus for hair holding and adornment as defined in claim 1 wherein said securement line means is detachably secured directly to said first securement member and said second securement member to facilitate placement and removal thereof.

12. An apparatus for hair holding and adornment as defined in claim 1 wherein said securement line means is detachably secured directly to said first base end section of said base member to be retained thereon by said first securement member being secured to said first base end section thereadjacent, and wherein said securement line means is also detachably secured directly to said second base end section of said base member to be retained thereon by said second securement member being secured to said second base end section thereadjacent.

13. An apparatus for hair holding and adornment as defined in claim 1 wherein said securement line means is detachably secured directly to said first base end section of said base member at a position thereon held between and in abutment with said first securement member and said first base end section to be retained in abutment therebetween by said first securement member being secured to said first base end section, and wherein said securement line means is also detachably secured directly to said second base end section of said base member at a position thereon held between and in abutment with said second securement member and said second base end section to be retained in abutment therebetween by said second securement member being secured to said second base end section.

14. An apparatus for hair holding and adornment comprising:

A. a base member extending longitudinally and including:
   (1) a first base end section;
   (2) a second base end section spatially disposed from said first base end section; and
   (3) a central base section defined on said base member between said first base end section and said second base end section;

B. a securement line means being detachably attachable with respect to said first base end section and to said second base end section and extending therebetween along said central base section, said securement line means being of a longitudinally extensible and flexibly resilient material, said securement line means and said base member defining a hair holding opening therebetween for receiving and retaining hair therewithin, said securement line means comprising an elastic rubber member which is longitudinally extensible and includes a fabric coating having a lower coefficient of friction than said elastic rubber member to facilitate ease of movement of hair in abutment thereagainst during placement and removal of the hair holding and adornment apparatus;

C. a first securement member, unconnected to said securement line means, and comprising a first cap means being detachably securable with respect to said first base end section of said base member, said first securement member being positionable adjacent said securement line means to facilitate maintaining detachable attachment thereof with respect to said first base end section of said base member, said first cap means defining a first capping bore means extending therewithin which is adapted to detachable receive said first base end section of said base member therein for facilitating detachable securement therewith; and D. a second securement member, unconnected to said securement line means, and comprising a second cap means being detachably securable with respect to said second base end section of said base member, said second securement member being positionable adjacent said securement line means to facilitate maintaining detachable attachment thereof with respect to said second base end section of said base member, said second cap means defines a second capping bore means extending therewithin which is adapted to detachable receive said second base end section of said base member therein for facilitating detachable securement therewith.

15. A method for holding and adornment the hair of a user comprising:

A. positioning a holding and adornment device having a longitudinal member and an elastic securement line detachably secured at opposite ends thereto adjacent to the hair of a user;

B. extending the user's hand through the opening defined between the elastic securement line and the longitudinal member;

C. grasping of a bundle of hair with the user's extended hand;

D. pulling of the bundle of hair through the hair holding opening defined between the longitudinal member and the elastic securement line;

E. rotating of the longitudinal member at least 180 degrees relative to the bundle of hair in order to encircle the bundle of hair with the elastic securement line;

F. placing of the same bundle of hair through the hair holding opening a second time;

G. wrapping the bundle of hair placed again through the hair holding opening laterally about the longitudinal member at least once around for gathering thereof; and H. inserting the holding and adornment device with the bundle of hair wrapped laterally around longitudinal member thereof into another area of the hair of the user for detachably affixing the bundle hair and the longitudinal member and the elastic securement line with respect to the user's hair for adornment.

16. A method for holding and adornment the hair of a user as defined in claim 15 further comprising removing of the holding and adornment device from the hair of a user by detaching the elastic securement line from the longitudinal member to allow longitudinal movement thereof outwardly from engagement with the hair of the user.

17. A method for holding and adornment the hair of a user as defined in claim 15 wherein said pulling of the bundle of hair through the hair holding opening and said placing of the same bundle of hair through the hair holding opening are performed in the same direction through the hair holding opening.

18. A method for holding and adornment the hair of a user as defined in claim 15 wherein said wrapping of the bundle of hair laterally about the longitudinal member is performed multiple times until the entire length of the bundle of hair is wrapped therearound.

19. A method for holding and adornment the hair of a user as defined in claim 15 further comprising placing a cap member on each opposite end of the longitudinal member to detachably retain the elastic securement line thereto is performed prior to positioning of the holding and adornment device adjacent the hair of a user.

20. A method for holding and adornment the hair of a user as defined in claim 15 further comprising detachably attaching of an auxiliary adornment device with respect to the holding and adornment device.

21. A method for holding and adornment the hair of a user as defined in claim 15 wherein said inserting of the holding and adornment device is performed beneath the other hair of the user to a position deep enough to place same completely beneath the user's hair to conceal the longitudinal member from sight.

22. A method for holding and adornment the hair of a user as defined in claim 15 wherein said positioning of the holding and adornment device is performed with the longitudinal member thereof oriented extending approximately vertically to facilitate extending of the user's hand through the opening therein for grasping of a hair bundle.

* * * * *